US005778843A

United States Patent [19]

Inoue et al.

[11] Patent Number: 5,778,843

[45] Date of Patent: Jul. 14, 1998

[54] AUXILIARY HEAT SOURCE APPARATUS FOR VEHICLE AND HEATING APPARATUS EMPLOYING THE SAME

[75] Inventors: Yoshimitsu Inoue, Chiryu; Shinji Aoki, Kariya; Toshio Morikawa, Toyota; Hajime Ito, Kariya; Hikaru Sugi, Nagoya; Takashi Ban, Kariya, all of Japan

[73] Assignees: Denso Corporation; Kabushiki Kaisha Toyoda Jidoshokki, both of Kariya, Japan

[21] Appl. No.: 933,295

[22] Filed: Sep. 18, 1997

[51] Int. Cl.[6] ..... F02N 17/02; F27B 3/06

[52] U.S. Cl. ..... 123/142.5 R; 122/26; 126/247

[58] Field of Search ..... 123/142.5 R; 122/26; 126/247

[56] References Cited

U.S. PATENT DOCUMENTS 4,480,592 11/1984 Gokcen ..... 122/26

4,993,377 2/1991 Itakura .

*Primary Examiner*—Erick R. Solis

*Attorney, Agent, or Firm*—Harness, Dickey & Pierce, P.L.C.

[57] ABSTRACT

According to the present invention, an oil storage chamber for temporarily accumulating a high-viscosity oil is formed below a heat-generating chamber for accumulating high-viscosity oil which generates heat when a shearing force is applied thereto. When an electromagnetic coil of an electromagnetic clutch is set off, i.e., a rotation of a rotor of a viscous heater is stopped, the high-viscosity oil in the heat-generating chamber moves into the oil storage chamber by own weight thereof, and a liquid level of the high-viscosity oil in the heat-generating chamber is greatly reduced. In this way, when the electromagnetic coil of the electromagnetic clutch is turned on to start the rotor of the viscous heater, a torque applied to the rotor is greatly reduced, with the result that a stress applied to the rotor is reduced.

18 Claims, 4 Drawing Sheets

AUXILIARY HEAT SOURCE APPARATUS FOR VEHICLE AND HEATING APPARATUS EMPLOYING THE SAME

CROSS REFERENCE TO THE RELATED APPLICATION

This application is based on and claims priority of Japanese Patent Application of No. Hei. 8-249411 filed on Sep. 20, 1996, the content of which is incorporated herein by reference.

BACKGROUND OF THE INVENTION

1. Field of the Invention

The present invention relates to an auxiliary heat source apparatus for a vehicle, which improves a heating capacity for a passenger compartment of the vehicle by using heat generated by viscous fluid in a heat-generating chamber when a shearing force is applied thereto.

2. Description of Related Art

Conventionally, as a heating apparatus for a vehicle, there has been generally known a hot water type heating apparatus for heating a passenger compartment, in which cooling water for cooling a water-cooled engine is supplied to a heater core disposed in a duct, and air heated while passing through the heater core is blown into the passenger compartment by a blower to heat the passenger compartment.

Further, in a case of the vehicle where the heat amount generated by the engine is small, such as a vehicle having a diesel engine or a lean burn engine, because the heat amount generated by the engine is too small to heat the cooling water sufficiently, a temperature of the cooling water in the cooling water circuit cannot be maintained at a predetermined temperature (e.g., 80° C.), there occurs a problem in that a heating capacity for the passenger compartment is insufficient.

To overcome such a problem, as disclosed in JP-A-2-246823, there has been conventionally proposed a heating apparatus for a vehicle, in which a heat-generating unit using a shearing force is disposed in a cooling water circuit for supplying cooling water from an engine to a heater core, and when a temperature of the cooling water in the cooling water circuit is lower than a predetermined temperature, the heat-generating unit is operated to improve the heating capacity.

The heat-generating unit transmits a rotational driving force of the engine to a shaft through a belt transmitting mechanism and an electromagnetic clutch, the heat-generating chamber is formed in a housing, and a cooling water passage is formed at an outer periphery of the heat-generating chamber. Further, a rotor which rotates integrally with the shaft is disposed in the heat-generating chamber, and a shearing force generated by a rotation of the rotor is applied to viscous fluid such as silicon oil sealed in the heat-generating chamber to generate heat. The cooling water is heated by the generated heat.

However, in the heating apparatus for a vehicle, equipped with the conventional heat-generating unit using the shearing force, when the heat-generating unit is started, i.e., that is, when a rotational driving force of the engine starts to be transmitted to the rotor, the rotor is started in the viscous fluid, and a large torque is applied to the rotor, the electromagnetic clutch, and the belt mechanism. As a result, there occurs a problem that a slipping of the electromagnetic clutch may be caused, or abnormal noise (chattering noise) may be generated by a slipping of a belt of the belt mechanism.

Especially, when the heat-generating unit using the shearing force is started after being left for a long time in winter season where the outside air temperature is low, because the viscosity of the viscous fluid having a low temperature is extremely high, a shock applied to the rotor is extremely high, and a stress applied to each parts of the heat-generating unit becomes extremely high. Therefore, there occurs a problem that durability of each portion of the heat-generating unit may deteriorate. When the electromagnetic clutch is turned on or off to control the heating capacity for the passenger compartment, the problem similar to that when the heat-generating unit is started occurs.

SUMMARY OF THE INVENTION

In view of the above-described problems, it is accordingly an object of the present invention to provide an auxiliary heat source apparatus for a vehicle, capable of improving the durability of each portion of the heat-generating unit by reducing the stress applied to each portion of the heat-generating unit when the rotor of the heat-generating unit is started.

According to the present invention, in an auxiliary heat source apparatus for a vehicle having a driving source, a heat-generating unit using a shearing force, for heating a thermal medium by heat generated by a viscous fluid in a heat-generating chamber thereof when a shearing force by a rotational driving force of a rotor is applied thereto, is provided with liquid level dropping means for temporarily dropping a liquid level of the viscous fluid in the heat-generating chamber when a rotational speed of the rotor is less than a predetermined rotational speed.

In this way, by means of the liquid level dropping means disposed in the heat-generating chamber, when the rotational speed of the rotor is less than a predetermined rotational speed, the liquid level of the viscous fluid in the heat-generating chamber is temporarily dropped. Therefore, a torque at a start of the rotor can be reduced, and a shock of the rotor is relieved. Accordingly, a stress applied to each portion of the heat-generating unit can be reduced, and noise can be suppressed from being generated.

Further, even if a clutch driven by and connected to the driving source, for intermitting a transmission of the rotational driving force from the driving source to the rotor is employed, or a driving force transmitting means disposed between the driving source and the clutch is further employed, a stress applied to the clutch or the driving force transmitting means can be reduced at the start of the rotor, and noise can be suppressed from being generated.

Further, as liquid level dropping means, a storage portion may be formed at a lower portion of the heat-generating chamber in fluid communication therewith, into which the viscous fluid in the heat-generating chamber flows by own weight thereof.

Still further, the liquid level dropping means may drop the liquid level of the viscous fluid in the heat-generating chamber to be lower than a rotation center of the rotor. In this way, the torque at the start of the rotor can be greatly reduced.

Further, the liquid level dropping means may drop the liquid level of the viscous fluid in the heat-generating chamber to such an extent that only an amount of the viscous fluid in contact with an outer peripheral surface of the rotor remains in the heat-generating chamber. In this way, the torque at the start of the rotor can be further greatly reduced.

The above-described auxiliary heat source apparatus can be preferably employed in a heating apparatus having a heating heat exchanger for heating a passenger compartment of the vehicle by heat-exchanging between cooling water having cooled a water-cooled engine and air to be blown into the passenger compartment, to heat the cooling water.

BRIEF DESCRIPTION OF THE ACCOMPANYING DRAWINGS

Additional objects and advantages of the present invention will be more readily apparent from the following detailed description of preferred embodiments thereof when taken together with the accompanying drawings in which.

DETAILED DESCRIPTION OF THE PREFERRED EMBODIMENTS

Figure 1:
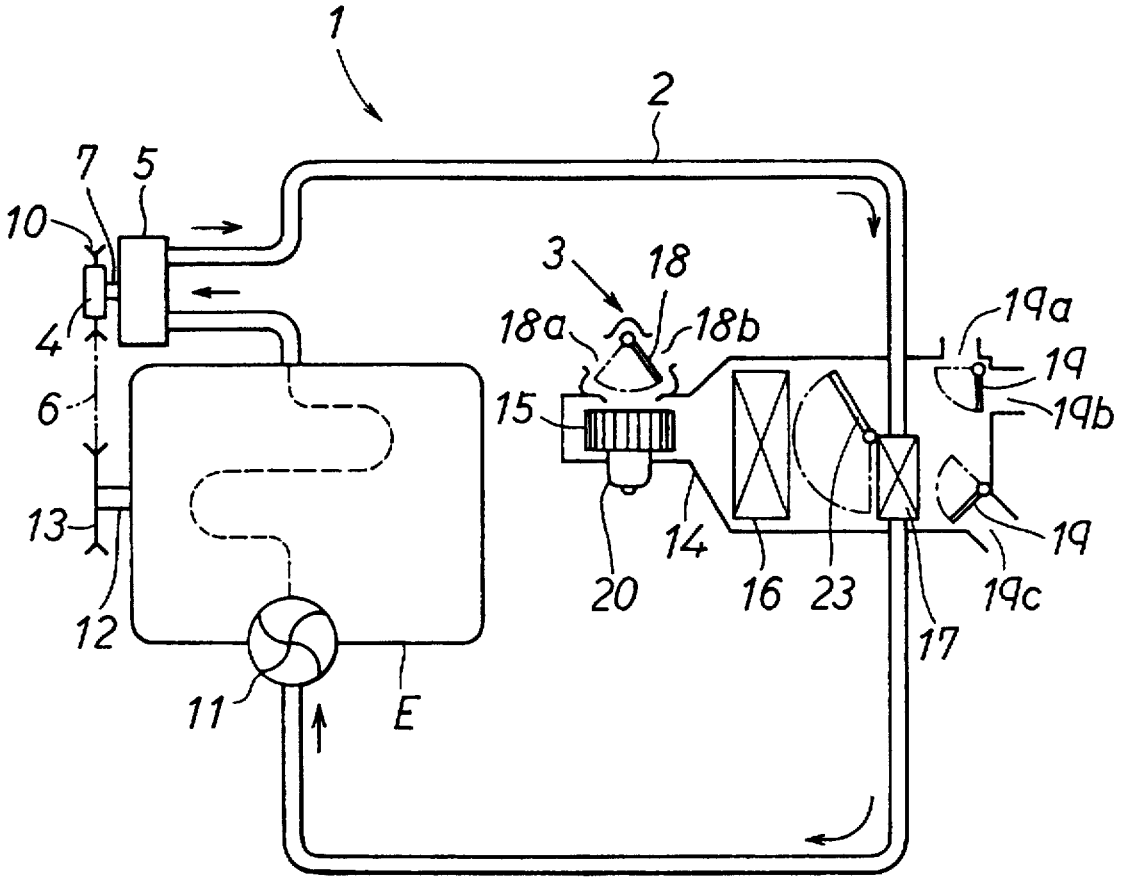
FIG. 1 is a schematic view showing an entire structure of an air conditioning apparatus for a vehicle, according to a first embodiment of the present invention.
Figure 2:
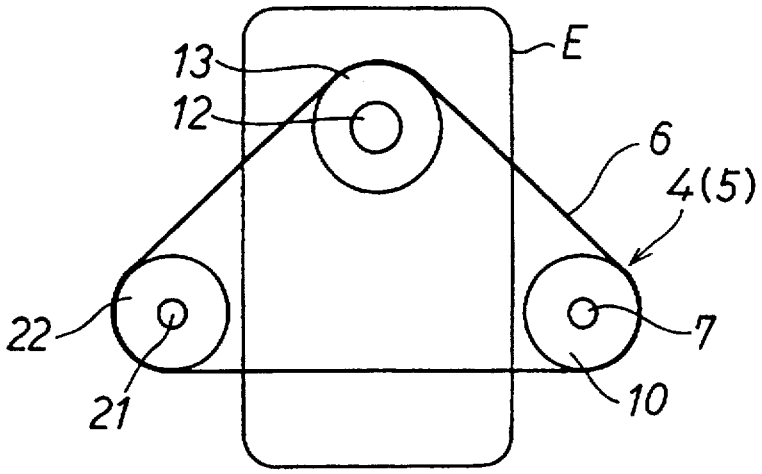
FIG. 2 is a schematic view showing an engine and a belt transmission mechanism in the first embodiment.

FIGS. 1 to 5 show a first embodiment of the present invention. FIG. 1 shows an entire structure of an air conditioning apparatus for a vehicle, and FIG. 2 shows an engine and a belt transmitting mechanism.

An air conditioning apparatus 1 for a vehicle is equipped with a water-cooled diesel engine E (hereinafter referred to as "engine") disposed in an engine compartment of a vehicle, an air conditioning unit (hereinafter referred to as "A/C unit") 3 for air-conditioning a passenger compartment, a belt transmitting mechanism driven by and connected to the engine E, an electromagnetic clutch 4 driven by and connected to the belt transmitting mechanism, a viscous heater 5 using heat generated when a rotational driving force of the engine E is transmitted thereto through the electromagnetic clutch 4 as an auxiliary heat source apparatus, an engine control unit (not shown) for controlling the engine E, and an air-conditioning control unit (not shown) for controlling the A/C unit 3.

The engine E which is a driving source for driving the viscous heater 5 is disposed in a cooling water circuit 2 through which cooling water circulates and has a water jacket therein. In the cooling water circuit 2, there is disposed a water pump 11 for pumping the cooling water in the cooling water circuit 2. Further, to an output shaft (crankshaft) 12 of the engine E, there is attached a crank pulley 13 driven by and connected to the belt transmitting mechanism.

The A/C unit 3 is constructed by a duct 14, a blower 15, an evaporator 16 of a refrigeration cycle, a heater core 17 disposed in the cooling water circuit 2, and the like. At an upwind side of the duct 14, there is rotatably provided an inside air/outside air switching door 18 for selectively opening and closing an outside air inlet 18*a* and an inside air inlet 18*b* to switch an air inlet mode.

At an downwind side of the duct 14, there is rotatably provided a mode switching door 19 for selectively opening and closing a defroster air outlet 19*a*, a face air outlet 19*b* and a foot air outlet 19*c* to switch an air outlet mode.

The blower 15 is rotated by a blower motor 20 to generate an air flow toward the passenger compartment in the duct 14.

The evaporator 16 is a refrigerant evaporator for cooling the air flowing in the duct 14 and constructs the refrigeration cycle with a compressor, a condenser (refrigerant condenser), a receiver (gas-liquid separator), and an expansion valve (decompressing device). The compressor is a refrigerant compressor for compressing and discharging the refrigerant when a rotational driving force is applied thereto. A V-pulley 22 driven by and connected to a driving shaft 21 of the compressor is driven by and connected to the crank pulley 13 of the engine E through a V-belt (described later) of the belt transmitting mechanism.

The heater core 17 is disposed within the duct 14 at a downstream side (downwind side) of the evaporator 16 with reference to the air flow direction and is connected to the cooling water circuit 2 at a downstream side of the viscous heater 5 with reference to the flow direction of the cooling water. The heater core 17 is a heating heat exchanger for heating air by heat-exchanging the air having passed through the evaporator 16 and the cooling water. At an upwind side of the front heater core 15, there is rotatably provided an air-mixing door 23. The air-mixing door 23 adjusts a ratio between an amount of air (warm air) passing through the front heater core 17 and an amount of air (cool air) bypassing the heater core 17 so that a temperature of air blown out into the passenger compartment can be adjusted.

The belt transmitting mechanism is composed of a multi-stage type V-belt for drivingly connecting the crank pulley 13 of the engine E, the V-pulley 10 of the electromagnetic clutch 4, and the V-pulley of the compressor. The V-belt 6 is for transmitting a rotational driving force of the engine E to the viscous heater 5 and the compressor. The V-belt 6 of the belt transmitting mechanism may be also hung on a V-pulley of an auxiliary equipment for an engine (such as a hydraulic pump for pumping lubricating oil to the engine E) a V-pulley of the water pump 11, or the like.

Figure 3:
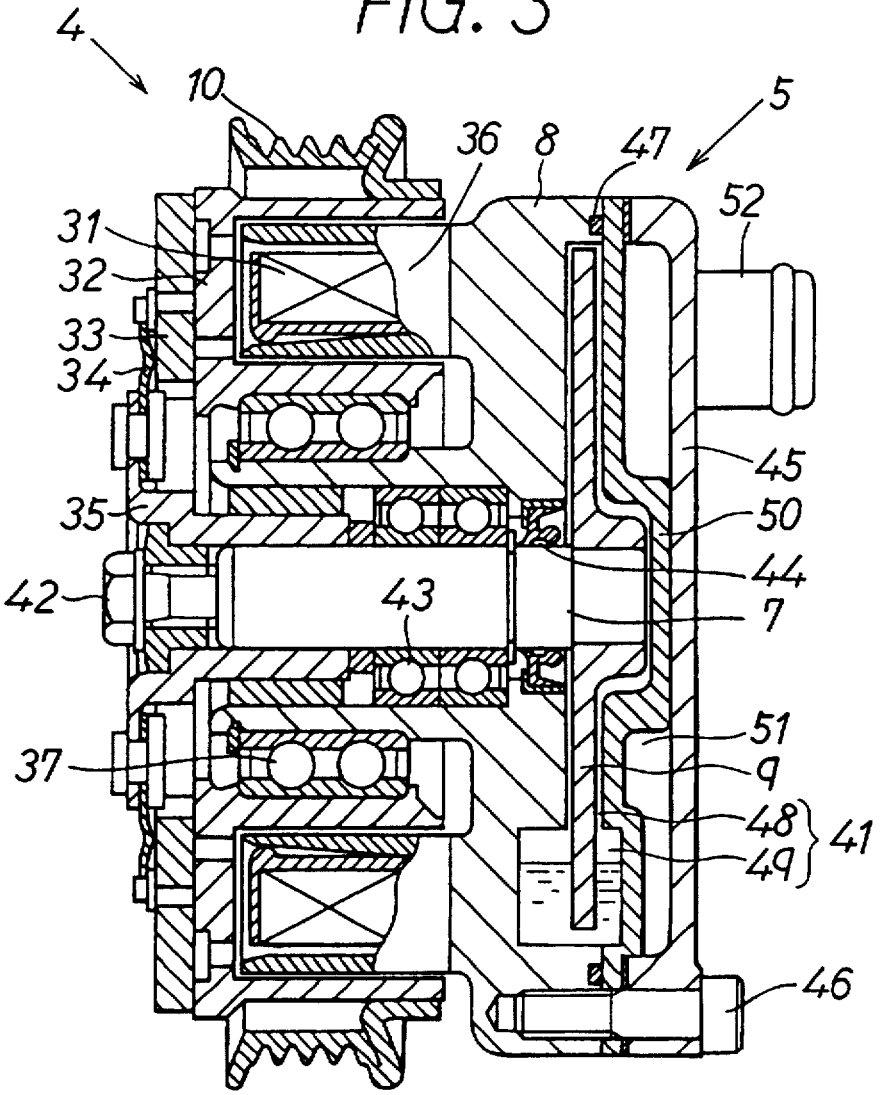
FIG. 3 is a transverse cross sectional view showing a viscous clutch and a viscous heater in the first embodiment.

The electromagnetic clutch 4 is for intermitting a rotational driving force transmitted from the engine E to a shaft 7 and a rotor 9 of the viscous heater 5, as shown in FIG. 3. The electromagnetic clutch 4 is constructed by an electromagnetic coil 31 for generating a magnetomotive force when an electric current is supplied thereto, a rotor 32 rotated by the engine E, an armature 33 attracted toward the rotor 32 by the magnetomotive force, an inner hub 35 connected to the armature 33 with a plate spring 34 and supplying a rotational driving force to the shaft 7 of the viscous heater 5, and the like.

The electromagnetic coil 31 is structured by winding a conductive lead wire covered with an insulating material. The electromagnetic coil 31 is disposed in a stator 36 and is fixedly molded in the stator 36 with an epoxy resin. The stator 36 is fixed on a front surface of a housing 8 of the viscous heater 5.

A V-pulley 10 for hanging the V-belt 6 on a periphery thereof is joined to the rotor 32 by joining means such as welding. The rotor 32 is a rotating body (input portion of the electromagnetic clutch 4) which always rotates by a rotational driving force of the engine E, transmitted thereto through the V-belt 6. The V-belt 6 is hung on the V-pulley 10, and the V-pulley 10 always rotates by a rotational driving force of the engine E, transmitted thereto through the V-belt 6. The rotor 33 is a first friction member formed of magnetic material to have a U-shaped cross section and is rotatably supported on an outer periphery of the housing 8 of the viscous heater 5 with a bearing 48 disposed in an inner periphery thereof.

The armature 33 is a second friction member formed of magnetic material and having a friction surface formed in a ring-shaped plate, which is opposed to a friction surface of the rotor 32, formed in a ring-shaped plate, by an air gap (e.g., a clearance of 0.5 mm) therebetween. When the armature 43 is attracted to the friction surface of the rotor 32 by the electromotive force of the electromagnetic coil 31, the rotational driving force of the engine E is transmitted from the rotor 32 to the armature 33.

The plate spring 34 is fixed to the armature 33 at an outer peripheral side by fixing means such as a rivet and is fixed to the inner hub 35 at an inner peripheral side by fixing means such as a rivet. The plate spring 34 is an elastic member for displacing the armature 33 in a direction (the left direction in the drawing) as to be separated (released) from the friction surface of the rotor 32 when the supply of the electric current to the electromagnetic coil 31 is stopped, to return the armature 33 to an initial position thereof.

The inner hub 35 is an output portion of the electromagnetic clutch 4 such that the input side thereof is connected to and driven by the armature 33 through the plate spring 34 and the output side is connected to and driven by the shaft 7 of the viscous heater 5 with a spline fitting connection.

Figure 4:
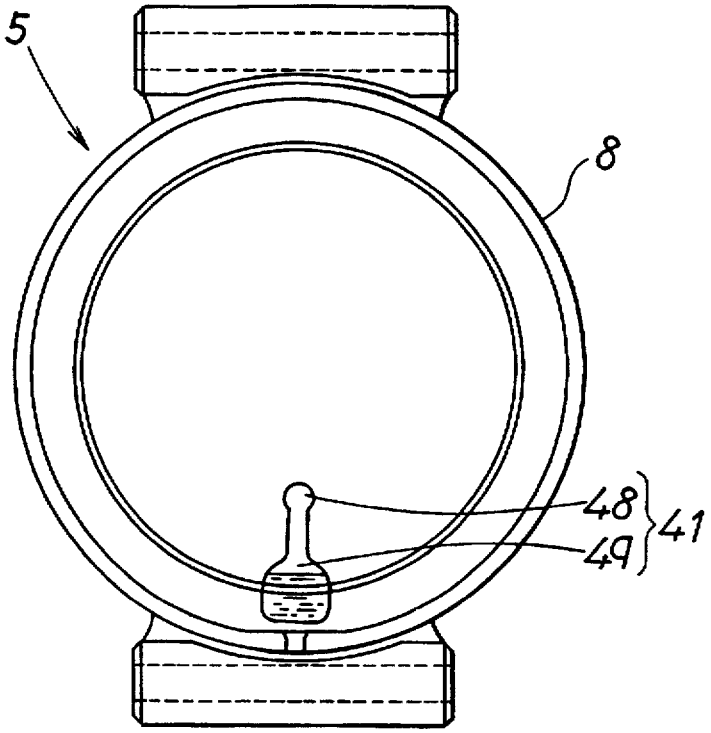
FIG. 4 is a longitudinal cross sectional view showing the viscous heater in the first embodiment.

The viscous heater 5 is a heat-generating unit using a shearing force, and is constructed by, as shown by FIGS. 3 to 5, the shaft 7 rotated by the engine E through the V-belt 6 and the electromagnetic clutch 4, the housing 8 for rotatably supporting the shaft 7, a separator 50 for dividing an inner space of the housing 10 into an oil chamber 41 and a cooling water passage 51, a rotor 9 rotatably disposed in the housing 8, and the like.

The shaft 7 is a rotary shaft (input shaft) which is fixedly fastened to the inner hub 35 of the electromagnetic clutch 4 by fastening means 42 such as a bolt and rotates integrally with the armature 33. The shaft 7 is rotatably disposed in an inner periphery of the housing 8 with a bearing 43 such as a ball bearing and a sealing member 44. The sealing member 44 employs an oil-seal for preventing a leakage of the high-viscosity oil.

The housing 8 is made of a metallic member such as aluminum alloy. A cover 45 formed in a ring-shaped plate is fixedly fastened to a rear end of the housing 8 by fastening means 46 such as a bolt. On a surface where the housing 8 and the cover 45 are joined, there are disposed the separator 50 and a sealing member 47. The sealing member 47 employs an oil-seal for preventing a leakage of the high-viscosity oil. In an oil chamber 41 formed between a rear end surface of the housing 8 and a front end surface of the separator 50, there are provided a heat-generating chamber (shearing chamber) 48 and an oil storage chamber (oil storage tank) 49 both for sealing high-viscosity oil (viscous fluid such as silicon oil) which generates heat when a shearing force is applied thereto. When the rotation of the rotor 9 is stopped, both of the heat-generating chamber 48 and the oil storage chamber 49 accumulate approximately 30 g (approximately 30 cc) of the high-viscosity oil.

The oil storage chamber 49 is, as shown in FIGS. 3 and 4, formed below the heat-generating chamber 48 in communication therewith. The oil storage chamber 49 is formed to expand in such a manner that a size thereof in the axial direction (front-rear direction) is larger than that of the heat-generating chamber 48 and also that a size of the oil storage chamber 49 in the rotational direction of the rotor 9. The oil storage chamber 49 may be formed to expand, relative to the heat-generating chamber 48, in the downward radial direction of the rotor 9, as far as an amount of the high-viscosity oil in the heat-generating chamber 48 can be reduced when the rotation of the rotor 9 is stopped.

The oil storage chamber 49 is for dropping a liquid level of the high-viscosity oil in the heat-generating chamber 48 to be lower than a rotation center of the shaft 7 and the rotor 9, because the high-viscosity oil in the heat-generating flows into the oil storage chamber 49 by own weight thereof when the rotation of the rotor 9 is stopped. A volume of the oil storage chamber 49 is set to such an extent that the high-viscosity oil contacts an outer peripheral portion of the rotor 9 (5 mm of an overlapped margin with the rotor 9, or from 5 percent to 20 percent both inclusive of an outer surface of the rotor 9) when the rotation of the rotor 9 is stopped, i.e., all of the high-viscosity oil is in the oil storage chamber 49. The oil storage chamber 49 may be formed to reduce the liquid level of the viscous fluid in the heat-generating chamber 48 in such a manner that an amount of the viscous fluid only in contact with the outer surface of the rotor 9 still remains in the heat-generating chamber 48 when the rotation of the rotor 9 is stopped. Further, the heat-generating chamber 48 may be of a labyrinth structure formed between the separator 50 and the rotor 9 and having a space bent with a curvature of 1 or more.

The separator 50 is a partition member which is made of a metallic member such as aluminum alloy, which is superior in heat conductivity. An outer peripheral portion of the separator 50 is sandwiched between a cylindrical portion of the housing 8 and a cylindrical portion of the cover 45. Between a rear end surface and the cover 45, there is formed the cooling water passage 51, which are liquid-tightly partitioned from the outside and in which the cooling water having cooled the engine E circulates. Further, on the rear end surface of the separator 50 at a lower side, there are integrally formed a plurality of fin portions (not shown) having a substantially arcuate shape, for transmitting heat of the high-viscosity oil to the cooling water efficiently. Instead of the fin portions, the rear end surface of the separator 50 may be formed in a convex and concave shape, or a heat transmission facilitating member such as a corrugated fin and a fine pin fin may be provided on a rear end surface of the separator 50.

The cooling water passage 51 is partitioned into an upstream side water passage **51*a* and a downstream side water passage 51*b* by a partition wall (not shown) formed integrally with the rear end surface of the separator 52. To an upper end portion of an outer wall portion of the cover 45, there are connected an inlet-side cooling water pipe (not shown) for introducing the cooling water into the cooling water passage 51 and an outlet-side cooling water pipe 52** through which the cooling water from the inlet-side cooling water pipe flows out.

The rotor 9 is rotatably disposed in the heat-generating chamber 48 and is fixed to an outer periphery of the rear end portion of the shaft 7. On an outer peripheral surface or both side wall surfaces of the rotor 9, there are formed a plurality of groove portions (not shown). Between the adjacent groove portions, there is formed a protrusion portion (tooth portion). When a rotational driving force of the engine E is supplied to the shaft 7, the rotor 9 rotates integrally with the shaft 7 to generate a shearing force to the high-viscosity oil sealed in the heat-generating chamber 48.

Next, an operation of the air-conditioning apparatus 1 according to the embodiment will be briefly described with reference to FIGS. 1 to 5.

When the engine E starts, the crankshaft 11 rotates, and the rotational driving force of the engine E is transmitted to the rotor 32 of the electromagnetic clutch 4 through the crank pulley 13, the V-belt 6, and the V-pulley 10. When the electromagnetic clutch 4 (the electromagnetic coil 31) is set off, the armature 33 is not attracted to the friction surface of the rotor 32, and the rotational driving force of the engine E is not transmitted to the inner hub 35 and the shaft 7, with the result that the rotor 42 races simply.

Figure 5A:
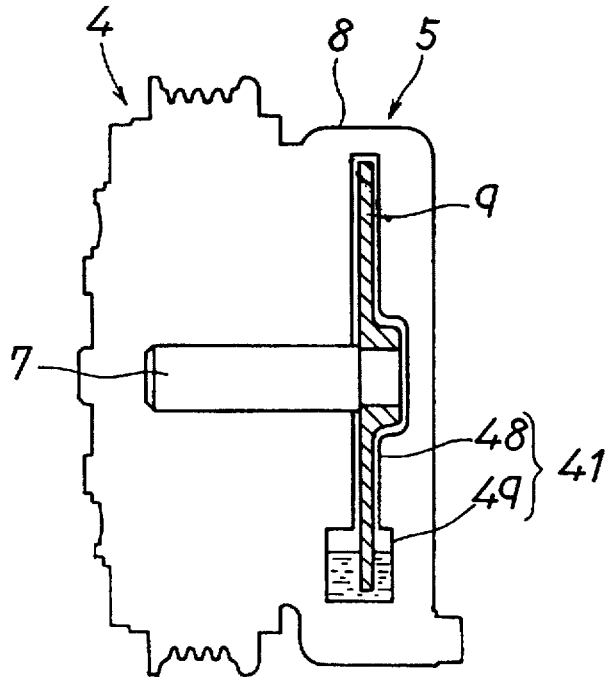
FIGS. 5A and 5B are explanatory views show a variation of a liquid level of a high-viscosity oil according to operation states of a rotor.

In this way, since the shaft 8 and the rotor 53 do not rotate, a shearing force is not applied to a part of the high-viscosity oil in the heat-generating chamber 48. As shown in FIG. 5A, most of the high-viscosity oil is stored in the oil storage chamber 49, and the high-viscosity oil does not generate heat. Therefore, even when the cooling water having cooled the engine E passes through the cooling water passage 51 of the viscous heater 5, the cooling water is supplied to the heater core 17 without being heated. Accordingly, a heating operation for the passenger compartment is started with a small heating capacity.

Here, when a temperature of the cooling water in the cooling water circuit 2 is lower than a set cooling water temperature (set value), the electromagnetic clutch 4 (the electromagnetic coil 31) is turned on. Therefore, the armature 33 is attracted to the friction surface of the rotor 32 with magnetomotive force of the electromagnetic coil 31 to transmit the rotational driving force of the engine E to the inner hub 35 and the shaft 7.

Figure 5B:
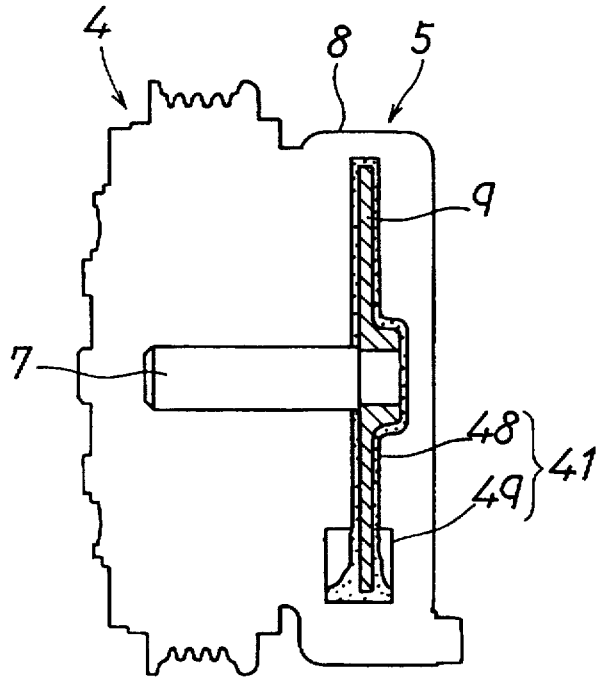

In this way, the shaft 7 and the rotor 9 rotate, the high-viscosity oil in the oil storage chamber 49 is drawn into the outer peripheral portion of the rotor 9, and is gradually sucked to contact the front surface of the rotor 9 so that the high-viscosity oil is filled entirely in the heat-generating chamber 48 as shown in FIG. 5B (Weissenberg effect).

Accordingly, the shearing force is applied to the high-viscosity oil in the heat-generating chamber 48, and the high-viscosity oil generates heat. Therefore, when the cooling water passes through the cooling water passage 51 of the viscous heater 5, the cooling water is heat while absorbing the heat generated by the high-viscosity oil. The cooling water heated by the viscous heater 5 is supplied to the heater core 7, and a heating operation is performed with a large heating capacity.

The above-described operation is repeated by turning on or off the electromagnetic coil 31 based on a relationship between the temperature of the cooling water in the cooling water circuit 2 and the set cooling water temperature.

As described above, in the viscous heater 5 of this embodiment, the oil storage chamber 49 is formed below the heat-generating chamber 48 (in the downward direction). When the electromagnetic clutch 4 (the electromagnetic coil 31) is set off, i.e., when the rotation of the rotor 9 is stopped, as shown in FIG. 3 and 5A, the high-viscosity oil in the heat-generating chamber 48 moves into the oil storage chamber 49 by own weight thereof, and the liquid level of the high-viscosity oil in the heat-generating chamber 48 lowers to such an extent that the high-viscosity oil contacts only the outer peripheral portion of the rotor 9.

Accordingly, the torque when the electromagnetic clutch 4 (the electromagnetic coil 31) is set on, i.e., when the rotor 9 is started, is greatly reduced, and the shock at the start of the rotor 9 is relieved. In this way, the stress applied to each portion of the viscous heater 5, especially, the connecting portion between the shaft 7 and the rotor 9, the connecting portion between the viscous heater 5 and the shaft 7, the viscous heater 5 and the V-belt 6 can be reduced, so that the durability of each portion of the viscous heater 5, the viscous heater 5, and the V-belt 6 can be improved.

Further, because the shock at the start of the rotor 9 of the viscous heater 5 is relieved, the slipping between the V-belt 6 as well as the rotor 32 of the electromagnetic clutch 4 and the armature 33 can be suppressed, the noise such as the belt chattering noise can be suppressed. Accordingly, it is advantageous to provide the oil storage chamber 49 below the heat-generating chamber 48 as in this embodiment especially when the viscous heater 5 is re-started after the vehicle has been left for a long time in winter season.

Further, by using the heat generated by the viscous heater 5 as the auxiliary heat source for heating operation to assist the engine E as the main heat source for heating operation, it is possible to heat the cooling water to be supplied to the heater core 17 sufficiently. Therefore, even in the vehicle where the heat amount generated by the engine is too small to heat the cooling water sufficiently with the exhaust heat of the engine E (e.g., a vehicle having a diesel engine or a lean burn engine), a temperature of the cooling water in the cooling water circuit can be maintained approximately at a predetermined temperature (e.g., 80° C.), so that the insufficiency of the heating capacity for the passenger compartment can be prevented.

Figure 6:
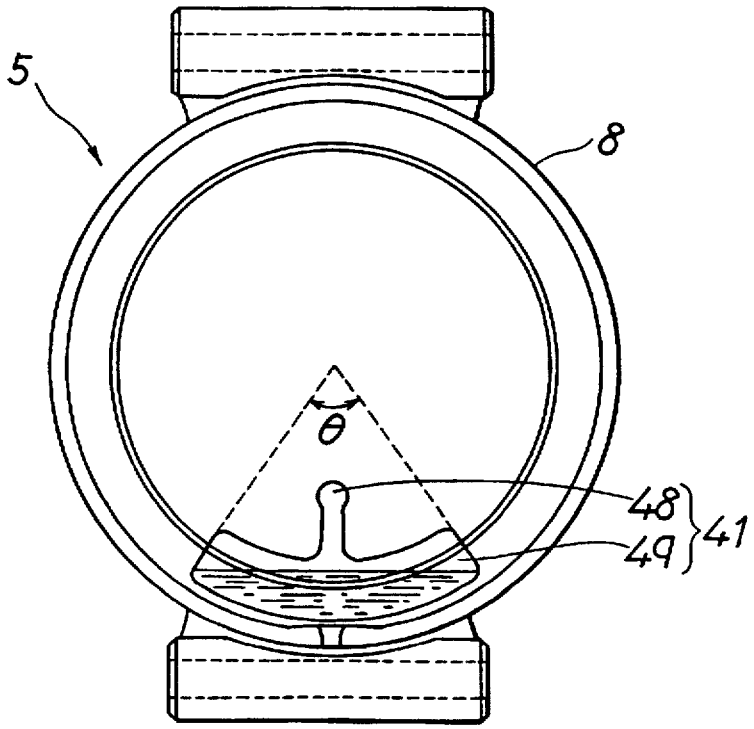
FIG. 6 is a longitudinal cross sectional view showing the viscous heater according to a second embodiment of the present invention.

A second embodiment of the present invention will be described with reference to FIG. 6.

In this embodiment, to obtain the effects similar to those in the first embodiment, even in a case where the viscous heater 5 is mounted on the vehicle while being inclined, the oil storage chamber 48 is formed in an arcuate shape (e.g., $\theta$=30° to 45°) by extending a size of the oil storage chamber 48 in both of the forward direction and the backward direction of the rotational direction of the rotor 9. The extending direction of the oil storage chamber 48 relative to the rotational direction of the rotor 9 may be either of the forward direction and the backward direction, or the tangential line relative to the rotational direction of the rotor 9 may be either of the forward direction and the backward direction.

In each of the above-described embodiments, the V-belt 6 and the electromagnetic clutch 4 are connected to and driven by the crankshaft 12 of the engine E to drive the rotor 9 of the viscous heater 5; however, the electromagnetic clutch 4 may be connected directly to the crankshaft 12 of the engine E to drive the rotor 9 of the viscous heater 5. Further, between the rotor 9 and the crankshaft 12 of the engine E, there may be connected a driving force transmitting apparatus (driving force transmitting means) such as a gear transmission having at least one stage gear and a V-belt type non-stage transmission. Further, the other clutch means such as a hydraulic type multiple disc clutch may be employed.

In each of the above-described embodiments, the water-cooled engine E is employed as the driving source; however, an electric motor or hydraulic motor may be employed as the driving source. Further, the rotor 9 of the viscous heater 5 may be driven by using a water-cooled engine, an air-cooled engine, or the other internal combustion engine not used as heat source for heating operation.

In each of the above-described embodiments, the present invention is applied to an air conditioning apparatus for a vehicle, capable of performing a heating operation and a cooling operation for the passenger compartment; however, the present invention may be applied to an air-conditioning apparatus for a vehicle, capable of performing only a heating operation for the passenger compartment. the present invention may be employed in an engine warm-up apparatus for performing a quick warm-up of the water-cooled engine E.

Here, as the cooling water, there may be employed cooling water to which anti-freeze liquid such as ethylene glycol solution is added, or coolant with which anti-freeze liquid or anti-corrosion agent is mixed. Instead of the cooling water, oil as thermal medium, refrigerant of the refrigeration cycle, or the like may be employed.

In the above-described embodiment, when the electromagnetic clutch 4 (the electromagnetic clutch 31) is set off, e.g., the rotational speed of the rotor 9 is a predetermined speed (0 r.p.m.), the high-viscosity oil moves from the heat-generating chamber 48 into the oil storage chamber 49; however, there may be employed a valve apparatus for moving the high-viscosity oil in the heat-generating chamber 48 into the oil storage chamber 49 when the rotational speed of the rotor 9 is equal to or less than a predetermined speed (e.g., 800 r.p.m.).

Although the present invention has been fully described in connection with the preferred embodiments thereof with reference to the accompanying drawings, it is to be noted that various changes and modifications will become apparent to those skilled in the art. Such changes and modifications are to be understood as being included within the scope of the present invention as defined in the appended claims.

What is claimed is:

1. An auxiliary heat source apparatus for a vehicle having a driving source, comprising:

a heat-generating unit using a shearing force, said heat-generating unit having a rotor which rotates when a rotational driving force of said driving source is applied thereto, and a heat-generating chamber for sealing therein viscous fluid which generates heat when a shearing force generated by a rotational driving force of said rotor is applied thereto, said heat-generating being for heating a thermal medium by heat generated by the viscous fluid in said heat-generating chamber; and liquid level dropping means provided in said heat-generating chamber, for temporarily dropping a liquid level of the viscous fluid in said heat-generating chamber when a rotational speed of said rotor is less than a predetermined rotational speed.

2. An auxiliary heat source apparatus according to claim 1, further comprising:

a clutch driven by and connected to said driving source, for intermitting a transmission of the rotational driving force from said driving source to said rotor.

3. An auxiliary heat source apparatus according to claim 2, wherein said clutch is connected to said driving source through a driving force transmitting means.

4. An auxiliary heat source apparatus according to claim 1, wherein said liquid level dropping means includes a storage portion formed at a lower portion of said heat-generating chamber in fluid communication therewith, into which the viscous fluid in said heat-generating chamber flows by own weight thereof.

5. An auxiliary heat source apparatus according to claim 4, wherein a size of said storage portion in an axial direction is larger than that of said heat-generating chamber.

6. An auxiliary heat source apparatus according to claim 4, wherein a size of said storage portion in a rotational direction of said rotor is larger than that of said heat-generating chamber.

7. An auxiliary heat source apparatus according to claim 1, wherein said liquid level dropping means drops the liquid level of the viscous fluid in said heat-generating chamber to be lower than a rotation center of said rotor.

8. An auxiliary heat source apparatus according to claim 1, wherein said liquid level dropping means drops the liquid level of the viscous fluid in said heat-generating chamber to such an extent that only an amount of the viscous fluid in contact with an outer peripheral surface of said rotor remains in said heat-generating chamber.

9. An auxiliary heat source apparatus for a vehicle having a driving source, comprising:

a heat-generating unit using a shearing force, said heat-generating unit including:

a rotor which rotates when a rotational driving force of said driving source is applied thereto;

a heat-generating chamber for sealing therein viscous fluid which generates heat when a shearing force generated by a rotational driving force of said rotor is applied thereto, said heat-generating being for heating a thermal medium by heat generated by the viscous fluid in said heat-generating chamber; and a storage chamber formed below said heat-generating chamber in the gravitational direction to be in fluid communication therewith.

10. An auxiliary heat source apparatus according to claim 9, wherein the viscous fluid in said heat-generating chamber flows into said storage chamber by own weight thereof when a rotational speed of said rotor is less than a predetermined rotational speed.

11. A heating apparatus for heating a passenger compartment of a vehicle having a water-cooled internal combustion engine, said heating apparatus comprising:

a heating heat exchanger for heating said passenger compartment by heat-exchanging between cooling water having cooled said water-cooled engine and air to be blown into said passenger compartment;

a heat-generating unit using a shearing force, said heat-generating unit having a rotor which rotates when a rotational driving force of said engine is applied thereto, a heat-generating chamber for sealing therein viscous fluid which generates heat when a shearing force generated by a rotational driving force of said rotor is applied thereto, and a cooling water passage in which the cooling water circulates between said engine and said heating heat exchanger, said heat-generating unit heating the cooling water to be supplied to said heating heat exchanger by generated heat of the viscous fluid in said heat-generating chamber; and liquid level dropping means provided in said heat-generating chamber, for temporarily dropping a liquid level of the viscous fluid in said heat-generating chamber when a rotational speed of said rotor is less than a predetermined rotational speed.

12. A heating apparatus according to claim 11, further comprising:

a clutch driven by and connected to said driving source, for intermitting a transmission of the rotational driving force from said driving source to said rotor.

13. A heating apparatus according to claim 12, wherein said clutch is connected to said driving source through a driving force transmitting means.

14. A heating apparatus according to claim 11, wherein said liquid level dropping means includes a storage portion formed at a lower portion of said heat-generating chamber in fluid communication therewith, into which the viscous fluid in said heat-generating chamber flows by own weight thereof.

15. A heating apparatus according to claim 14, wherein a size of said storage portion in an axial direction is larger than that of said heat-generating chamber.

16. A heating apparatus according to claim 14, wherein a size of said storage portion in a rotational direction of said rotor is larger than that of said heat-generating chamber.

17. A heating apparatus according to claim 11, wherein said liquid level dropping means drops the liquid level of the viscous fluid in said heat-generating chamber to be lower than a rotation center of said rotor.

18. A heating apparatus according to claim 11, wherein said liquid level dropping means drops the liquid level of the viscous fluid in said heat-generating chamber to such an extent that only an amount of the viscous fluid in contact with an outer peripheral surface of said rotor remains in said heat-generating chamber.

* * * * *

UNITED STATES PATENT AND TRADEMARK OFFICE

CERTIFICATE OF CORRECTION

PATENT NO. : 5,778,843

DATED : July 14, 1998

INVENTOR(S) : Yoshimitsu Inoue et al

It is certified that error appears in the above-identified patent and that said Letters Patent is hereby corrected as shown below:

Title Page, [73] Assignees, after "Jidoshokki" insert --Seisakusho--

Title Page, [30] Foreign Priority, insert --Sep. 20, 1996 [JP] Japan ....8-249411--

Col. 1, line 8, delete "of"

Col. 1, lines 59-60, delete "that is,"

Col. 2, line 6, delete "parts" and substitute --part-- therefor

Col. 2, line 53, after "by" insert --its--

Col. 3, line 22, delete "show" and substitute --showing-- therefor

Col. 3, line 66, delete "an" and substitute --a-- therefor

Col. 4, line 39, after "E)" insert a comma

Col. 6, line 9, after "generating" insert --chamber 48--

Col. 6, line 10, after "by" insert --its--

Col. 7, line 40, delete "heat" and substitute --heated-- therefor

Col. 7, line 54, delete "FIG." and substitute --FIGS.-- therefor

Col. 7, line 56, after "by" insert --its--

UNITED STATES PATENT AND TRADEMARK OFFICE

CERTIFICATE OF CORRECTION

PATENT NO. : 5,778,843

DATED : July 14, 1998

INVENTOR(S) : Yoshimitsu Inoue et al

It is certified that error appears in the above-identified patent and that said Letters Patent is hereby corrected as shown below:

Col. 8, lines 1-2, delete 2nd occurrence of "the viscous heater 5,"

Col. 8, line 6, after "suppressed," insert --and--

Col. 8, line 65, delete 2nd occurrence of "the" and substitute --The-- therefor

Col. 9, line 54, claim 4, after "by" insert --its--

Col. 10, line 21, claim 10, after "by" insert --its--

Col. 10, line 60, claim 14, after "by" insert --its--

Signed and Sealed this

Seventeenth Day of November, 1998

*Attest:*

*Attesting Officer*

Bruce Lehman

BRUCE LEHMAN

*Commissioner of Patents and Trademarks*